US010604909B2

(12) United States Patent
Wright et al.

(10) Patent No.: US 10,604,909 B2
(45) **Date of Patent: *Mar. 31, 2020**

(54) STACKABLE BUCKET

(71) Applicant: CWS Industries (Mfg) Corp., Surrey (CA)

(72) Inventors: Steve Wright, Surrey (CA); Bob Beales, Surrey (CA)

(73) Assignee: CWS INDUSTRIES (MFG) CORP., Surrey, British Columbia (CA)

( * ) Notice: Subject to any disclaimer, the term of this patent is extended or adjusted under 35 U.S.C. 154(b) by 457 days.

This patent is subject to a terminal disclaimer.

(21) Appl. No.: 14/839,969

(22) Filed: Aug. 29, 2015

(65) Prior Publication Data

US 2017/0002539 A1 Jan. 5, 2017

(30) Foreign Application Priority Data

Jun. 30, 2015 (CA) ..... 2895872
Aug. 5, 2015 (CA) ..... 2899431

(51) Int. Cl.
*E02F 3/40* (2006.01)
*E02F 3/34* (2006.01)

(52) U.S. Cl.
CPC ..... *E02F 3/40* (2013.01); *E02F 3/34* (2013.01); *E02F 3/3414* (2013.01)

(58) Field of Classification Search
CPC ... E02F 3/40; E02F 3/34; E02F 3/3414; E02F 3/342; E02F 5/025; E02F 3/401; B65D 21/00
USPC ..... 37/444, 264, 442
See application file for complete search history.

(56) References Cited

U.S. PATENT DOCUMENTS 2,330,847 A * 10/1943 Seal ..... E02F 3/34 37/408
2,480,384 A * 8/1949 Schwartz ..... E02F 3/40 37/442
2,743,021 A * 4/1956 Glenn ..... A47F 5/112 211/49.1
2,959,307 A * 11/1960 Schwartz ..... E02F 3/40 414/722
3,056,219 A * 10/1962 Jeffrey ..... E02F 3/40 37/444
3,305,952 A * 2/1967 Dressler ..... E01H 8/00 37/104
3,701,443 A 10/1972 Van Der Lely
(Continued)

FOREIGN PATENT DOCUMENTS

CA 2284437 A1 * 4/2000 ..... E02F 3/40
JP 10140597 A * 5/1998 ..... E02F 3/40

OTHER PUBLICATIONS http://www.australianbucketsupplies.com.au/manufacturing.html.

*Primary Examiner* — Thomas B Will
*Assistant Examiner* — Joan D Misa
(74) *Attorney, Agent, or Firm* — Muncy, Geissler, Olds & Lowe, PC

(57) ABSTRACT

A stackable bucket having a floor, a back wall, and two side walls has a tapered front to back floor but wherein the back wall is substantially rectangular. A diagonal bend allows each side plate to connect to the tapered floor and to the rectangular back wall. Gussets and double-ended reverse hooks may also be used to provide spacing between nested buckets.

12 Claims, 5 Drawing Sheets

(56) References Cited

U.S. PATENT DOCUMENTS 4,037,337 A * 7/1977 Hemphill ..... E02F 3/3604 37/444
4,251,933 A * 2/1981 Hemphill ..... E02F 9/2816 37/446
4,316,540 A * 2/1982 Lapham ..... B65D 21/04 206/507
4,538,955 A * 9/1985 Langenfeld ..... E02F 3/34 414/686
4,790,084 A * 12/1988 Anderson ..... E02F 3/968 37/403
4,797,051 A * 1/1989 Langenfeld ..... E02F 3/6273 414/686
4,859,130 A * 8/1989 Langenfeld ..... A01D 87/0061 414/703
4,995,760 A 2/1991 Probst
5,015,148 A * 5/1991 Johnson ..... E02F 3/34 414/715
5,692,761 A 12/1997 Havlovitz
6,186,735 B1 * 2/2001 Deyo ..... E02F 3/40 29/466
6,374,520 B1 4/2002 Westendorf
7,216,769 B2 5/2007 Palder
7,832,128 B2 11/2010 Doucette
7,992,329 B2 8/2011 Horton
8,015,734 B1 * 9/2011 Mills ..... E02F 3/40 37/444
8,240,070 B1 8/2012 Phillips
8,695,240 B2 4/2014 Mills
8,707,589 B2 4/2014 Hilton
8,875,422 B2 11/2014 Tanaka
9,624,044 B2 * 4/2017 Wright ..... B65D 19/44
2003/0005605 A1 * 1/2003 Kaczmarski ..... E02F 3/3627 37/444
2008/0041740 A1 2/2008 Hyp
2014/0001187 A1 1/2014 David
2014/0230293 A1 8/2014 Lunn
2014/0331528 A1 11/2014 Tanaka
2015/0101218 A1 * 4/2015 Serrurier ..... E02F 3/40 37/444

* cited by examiner

STACKABLE BUCKET

FIELD OF THE INVENTION

This invention relates to heavy equipment buckets. In particular, this invention relates to stackable heavy equipment buckets.

BACKGROUND OF THE INVENTION

A variety of bucket designs for heavy equipment such as skid steers and loaders are known in the art. For example U.S. Pat. No. 8,875,422 to Tanaka et al.; U.S. Pat. No. 8,707,589 to Hilton; U.S. Pat. No. 8,695,240 to Mills et al.; U.S. Pat. No. 8,240,070 to Phillips et al.; U.S. Pat. No. 7,992,329 to Horton; U.S. Pat. No. 7,832,128 to Doucette et al. and U.S. Patent Application Pub. Nos. 2014/0331528 to Tanaka et al. and 2014/0230293 to Lunn et al. all disclose various buckets.

The storage or shipping of buckets typically requires significant space. When such buckets are manufactured and shipped, multiple shipping containers, flat-bed trucks or trailers may be necessary for transportation depending on the number of buckets.

U.S. Pat. No. 6,374,520 to Westendorf et al. discloses a bucket providing a tapered floor and a tapered back wall allowing a nested stacking of buckets. In the Westendorf System, the buckets are most efficiently stacked in an alternating manner. But such alternate stacking is time intensive and requires significant space to maneuver the buckets into position.

It is an object of the invention to provide an improved stackable bucket that may be stacked quickly.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

The invention provides a stackable bucket by providing sides that include a bend to accommodate the dimensioning of a substantially rectangular top wall (having parallel side edges) while the floor of the bucket tapers from its straight leading edge to its trailing edge. This allows the sides to connect to both the tapering floor and the parallel side edges of the top wall to provide a stackable bucket.

In one aspect, the invention is a stackable bucket for skid steers and loaders having a substantially rectangular top wall having parallel side edges, a floor that tapers from a straight floor leading edge to a floor trailing edge, and sides that include a bend such that each of the sides connects to both the tapering floor and the parallel side edges of the top wall.

In another aspect, the invention is a stackable bucket for skid steers and loaders having a floor and a top wall. The floor has a straight floor leading edge and first and second floor side edges. The floor also has a floor trailing edge that is shorter in length than the straight floor leading edge. The top wall has a top wall leading edge. The top wall also has first and second top wall edges that are parallel to one another and a top wall trailing edge that is equal in length to the top wall leading edge. The top wall trailing edge is connected to the floor trailing edge.

In a more particular aspect, the first side wall is connected to the first floor side edge and the first top wall side edge. The second side wall is connected to the second floor side edge and the second top wall side edge. The first side wall has a first bend and the second side wall has a second bend. In a more specific aspect, the bend is diagonal in relation to the side walls.

The buckets may further comprise gussets connected between the top wall and the sides. In one aspect, the stackable bucket has a first gusset connected to the top wall and the first side plate and a second gusset connected to the top wall and the second side plate.

In another aspect, the invention is an assembly of stackable buckets wherein successive buckets nest into one another. The assembly comprises the successive buckets and at least one double-ended reverse hook. The double-ended reverse hook is installed on an outside of the bottom of a first of the buckets using a downward facing end of the hook. An opposed upward facing end of the hook supports a portion of the leading edge of the bottom of another of the buckets.

In another aspect, the downward facing end of the hook is engaged in a gap provided between a lip plate welded to the floor of the first bucket and a bolt-on edge connected to the lip plate.

In a further aspect, the invention is a method of stacking buckets. In the method, a first bucket is placed on a surface such that an opening of the first bucket faces downward. At least one double-ended reverse hook having a downward facing end and an opposing upward facing end is provided. The at least one double-ended reverse hook is placed on the outside of the bottom of the first bucket. A second bucket is placed over the first bucket such that the leading edge of the bottom of the second bucket is supported by the upward facing end of the at least one hook.

In more particular aspect, the leading edge of a bottom of the second bucket comprises a straight floor leading edge of the second bucket.

In another aspect, the leading edge of a bottom of the second bucket comprises a bolt-on edge and a lip plate.

In a further aspect, the downward facing end of the at least one double-ended reverse hook is placed in a gap between a lip plate welded to the floor of the first bucket and a bolt-on edge connected to the lip plate.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
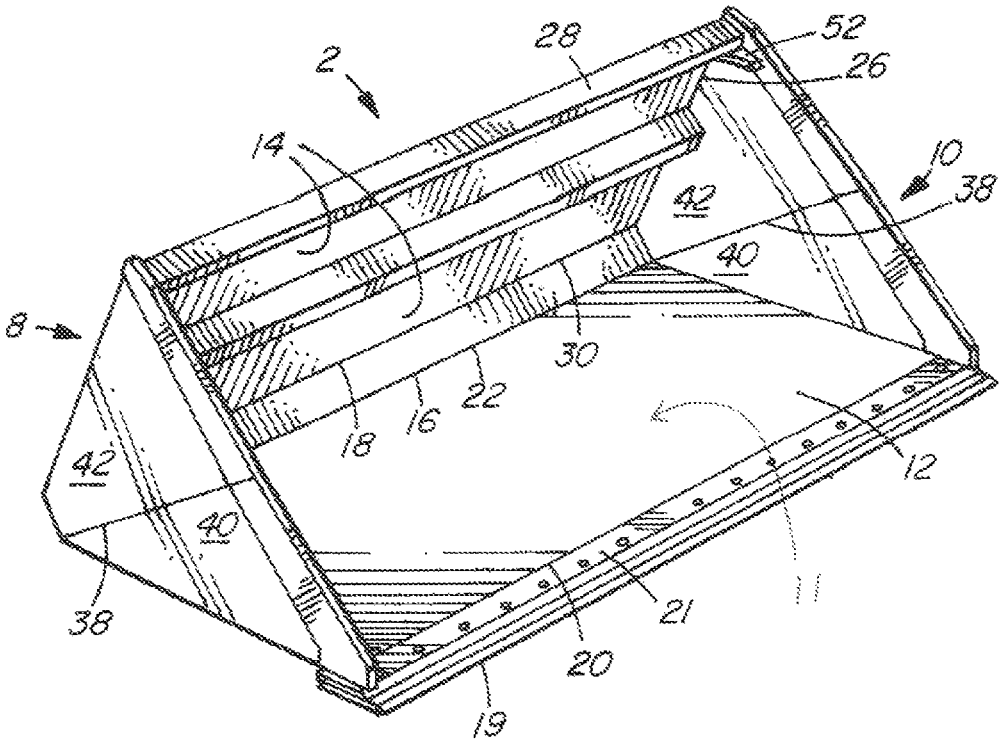
FIG. 1 is a perspective view of one embodiment of the stackable bucket.
Figure 2:
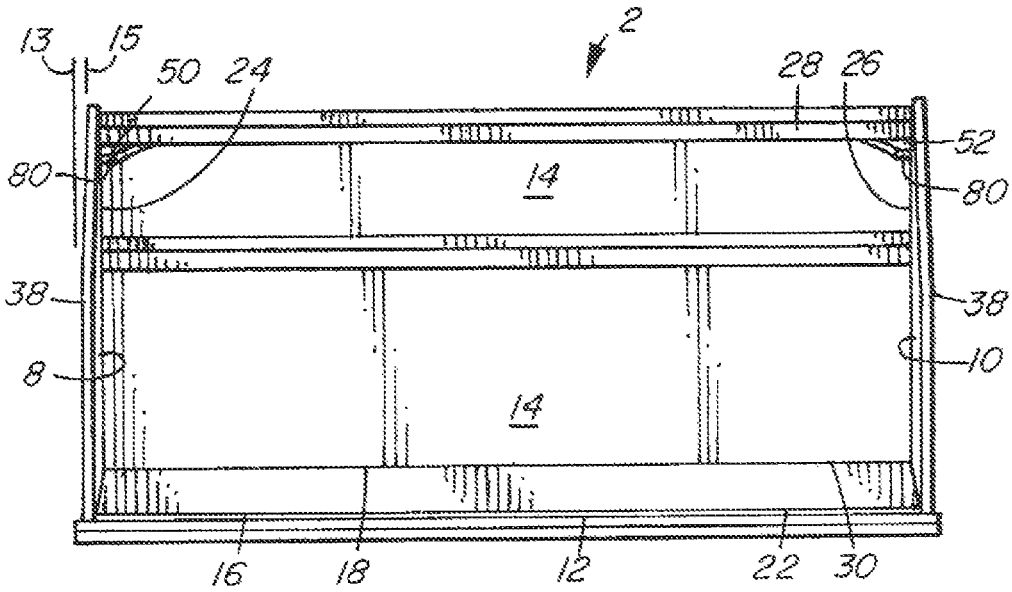
FIG. 2 is a front view of the stackable bucket of FIG. 1.
Figure 3:
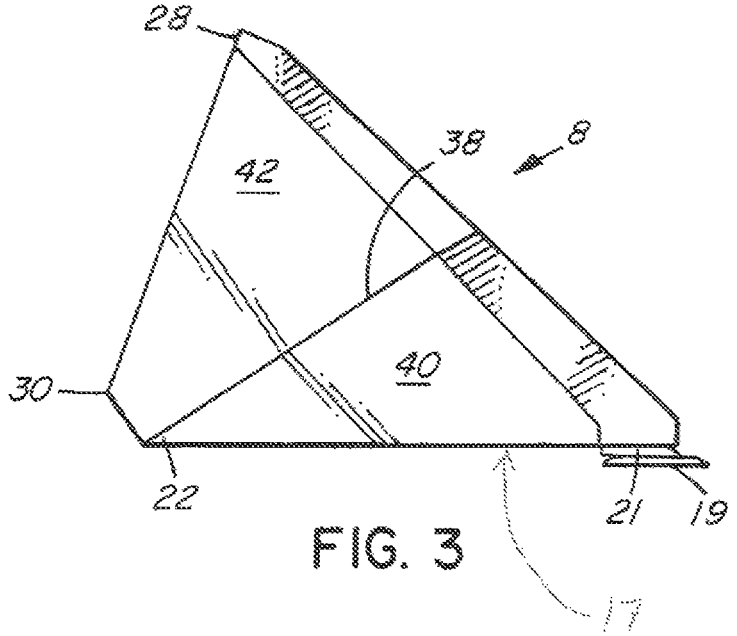
FIG. 3 is a side view of the stackable bucket of FIG. 1.

FIGS. 1 and 2 show the preferred embodiment of the bucket for use with heavy equipment such as skids steers and loaders. The bucket 2 comprises a floor 12, a top wall 14, and two side walls 8, 10. The floor 12 and top wall 14 may be formed by one or more metal plates. The floor 12 and top wall 14 together form a generally U-shaped or V-shaped structure. When the floor 12 of the bucket is parallel to the ground (as shown in FIGS. 1 and 3), the top wall 14 extends upwards at an acute angle to the floor 12.

The connection between the top wall 14 and the floor 12 may be an edge or a rounded corner. Alternatively, a strip of metal may connect the top wall 14 to the floor 12. In the embodiment shown in FIGS. 1 and 2, there are two bends 16, 18 between the top wall 14 and floor 12.

The floor 12 is complete planar and has a straight floor leading edge 20 and a floor trailing edge 22. The top wall 14 has a top wall leading edge 28 ("leading" as it is a forward of the floor trailing edge 22) and a top wall trailing edge 30. The floor 12 is tapered such that the straight floor leading edge 20 is longer than the floor trailing edge 22.

In the art, the width of buckets is used to describe the size of buckets, for example, '96" buckets', '84" buckets', and '102" buckets'. However the actual bucket width may vary from what is suggested by that nomenclature.

In the preferred embodiment, the straight floor leading edge 20 of a '96" bucket' is 95" while the floor trailing edge 22 is 90⅞". In contrast, the top wall 14 has side edges 24, 26 that are parallel and that connect to the two sides 8, 10 of the bucket. As the side edges are parallel, the leading edge 28 of the top wall 14 is equal in length to the trailing edge 30 of the top wall 14. In the preferred embodiment, the overall aspect of the top wall is substantially rectangular and the top wall leading and trailing edges are each 90½".

Diagonal bends 38 are provided on each side 8 and 10 in order to allow each side to connect to both the tapered floor 12 and the substantially rectangular top wall 14. The bend is shown as slight but visible in the edge view of FIG. 2. Reference lines 13, 15 allow an appreciation of the bend on the left side of the drawing. Referring to FIG. 3, the diagonal bend 38 separates the side 8 into a bottom portion 40 and a top portion 42. The bottom portion 40 of the side 8 extends upwards from and is substantially perpendicular to the tapered bucket floor 12. In the preferred embodiment, the top portion 42 of the side plate 8 above the bend is angled approximately 2° inwards in relation to the bottom portion of the plate. Side plate 10 on the opposite side mirrors side plate 8 in construction. The inwardly bent sides allow the side ends of the top wall to be parallel to one another while the floor 12 is tapered.

It will be appreciated that the angle between the top portion 42 and bottom portion 40 of the side plate 8 caused by the diagonal bend 38 may vary depending on the dimensions of the floor 12 and top wall 14. For instance, the greater the tapering of the floor, the larger the angle will need to be.

The stackable bucket may also have a lip plate 21 and bolt-on edge 19. The lip plate 21 is typically welded to the bucket floor 12 whereas the bolt-on edge 19 may be removed and replaced upon wear.

The leading edge 28 of the top wall 14 is shorter than the lip plate 21 and bolt-on edge 19 at the front edge of the floor 12 of the bucket. This reduces the probability of the top corners snagging or catching on objects. The narrower width at the top of the bucket compared to the front lip of the bucket also enhances the ability to discharge materials such as soil since the difference in width tends to prevent such materials from packing or compressing tightly within the bucket.

Figure 5:
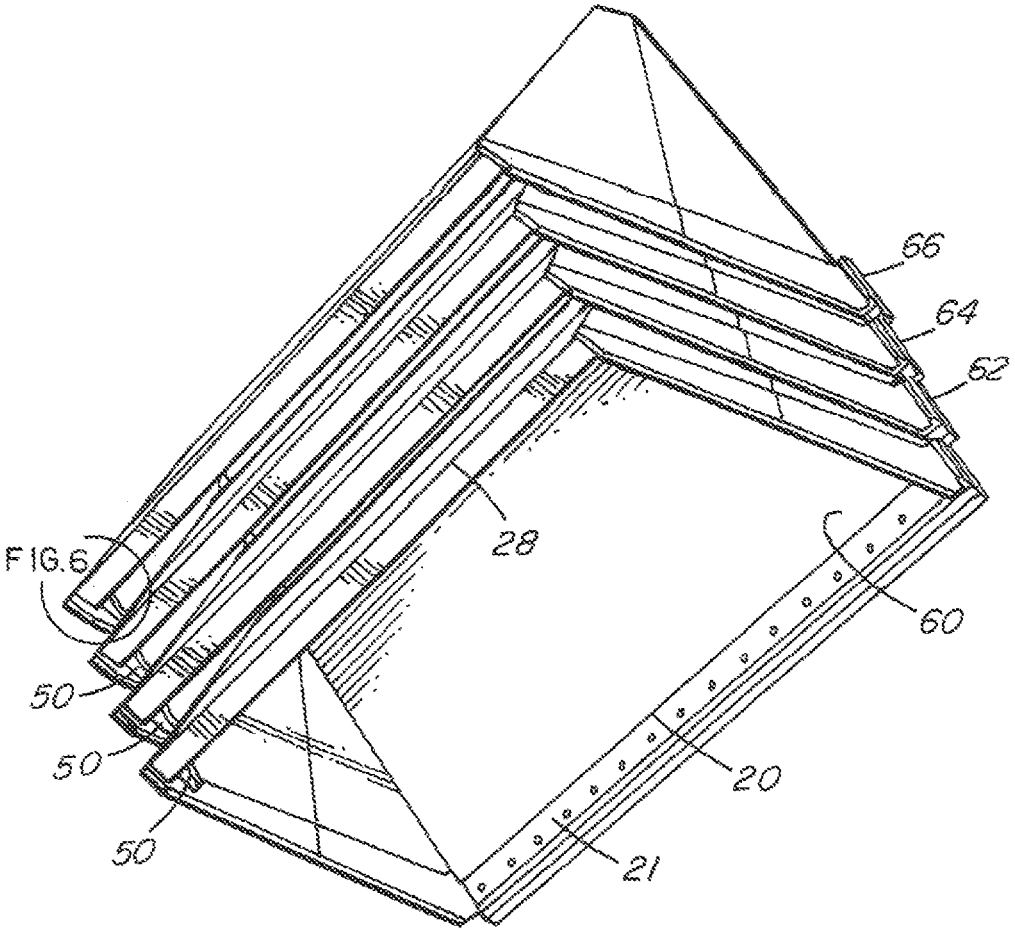
FIG. 5 is an underside perspective view of a stack of four buckets shown in FIG. 4.
Figure 6:
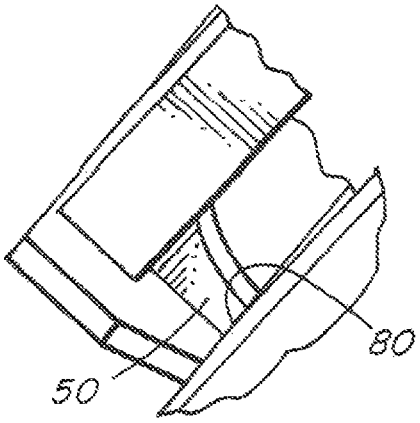
FIG. 6 is an enlarged view of a portion of the stack of four buckets shown in FIG. 5.

The bucket also has two gussets 50, 52. The first gusset 50 is connected to the top wall 14 and the side 8 and the second gusset 52 is connected to the top wall 14 and the side 10. As best shown in FIGS. 2 and 6, the gussets 50, 52 have a flat portion 80. In a stack of buckets as shown in FIG. 5, the flat portions of the two gussets 50, 52 of a first bucket rest on the sides 8 and 10 of a second bucket directly below the first bucket. This creates space between the top walls of stacked buckets and reduces scratching and paint damage during shipping or storage. The space between each bucket in the stack of buckets also prevents buckets from becoming stuck within each other.

Figure 4:
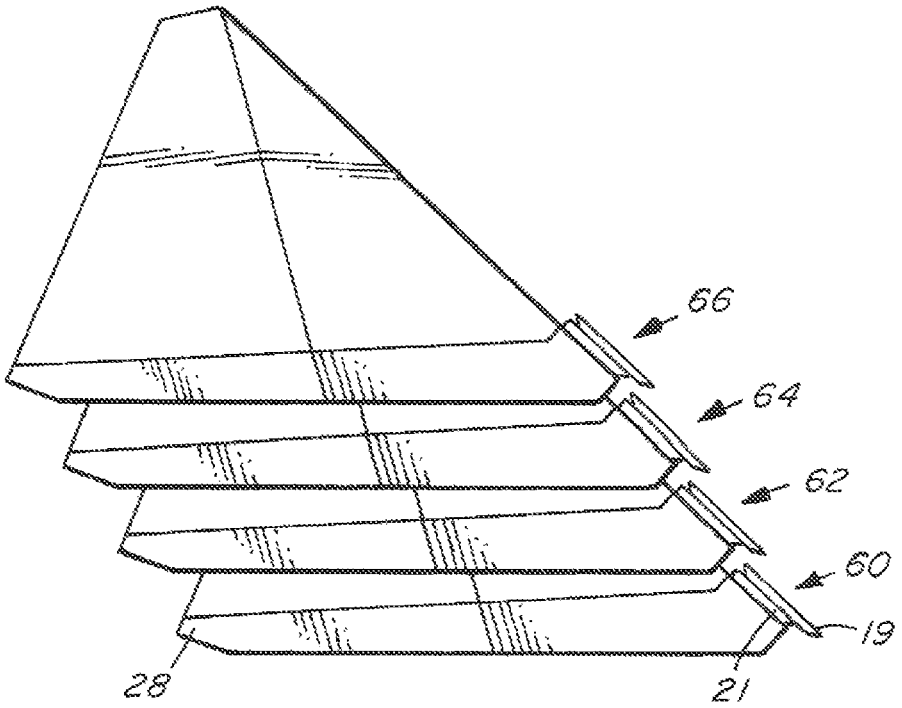
FIG. 4 is a side view of a stack of four buckets according to one embodiment of the invention.

Referring to FIGS. 4 and 5, in operation, a user places a first bucket 60 on the ground or other support with the bucket opening facing downwards. In this orientation, the bucket straight floor leading edge 20 and bucket top wall leading edge 28 contact or are in close proximity to the ground. The next bucket 62 is then placed on top of the first bucket 60 in the same orientation as the first bucket 60. Additional buckets 64 and 66 may then be placed on top of the stack of buckets.

Figure 7:
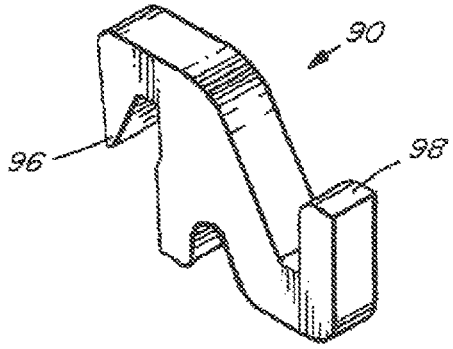
FIG. 7 is a perspective view of a double-ended reverse hook for use with stacked buckets.

In some cases, it may be desirable to further avoid the scuffing that might occur when nesting stackable buckets inside one another. According to one embodiment, there is also provided a double-ended reverse hook 90, the preferred embodiment of which is shown in FIG. 7 to maintain spacing between the floors of the nested buckets. If the nested buckets also have gussets 50, 52, then the hooks 90 are placed at the side of the buckets opposite to the gussets 50, 52. The hook 90 has a downward facing hook portion 96 and an upward facing hook portion 98. The use of the double-ended reverse hook 90 between buckets also results in greater stability in the stack of buckets and decreases the likelihood that sequentially stacked buckets will become stuck within one another.

Figure 8:
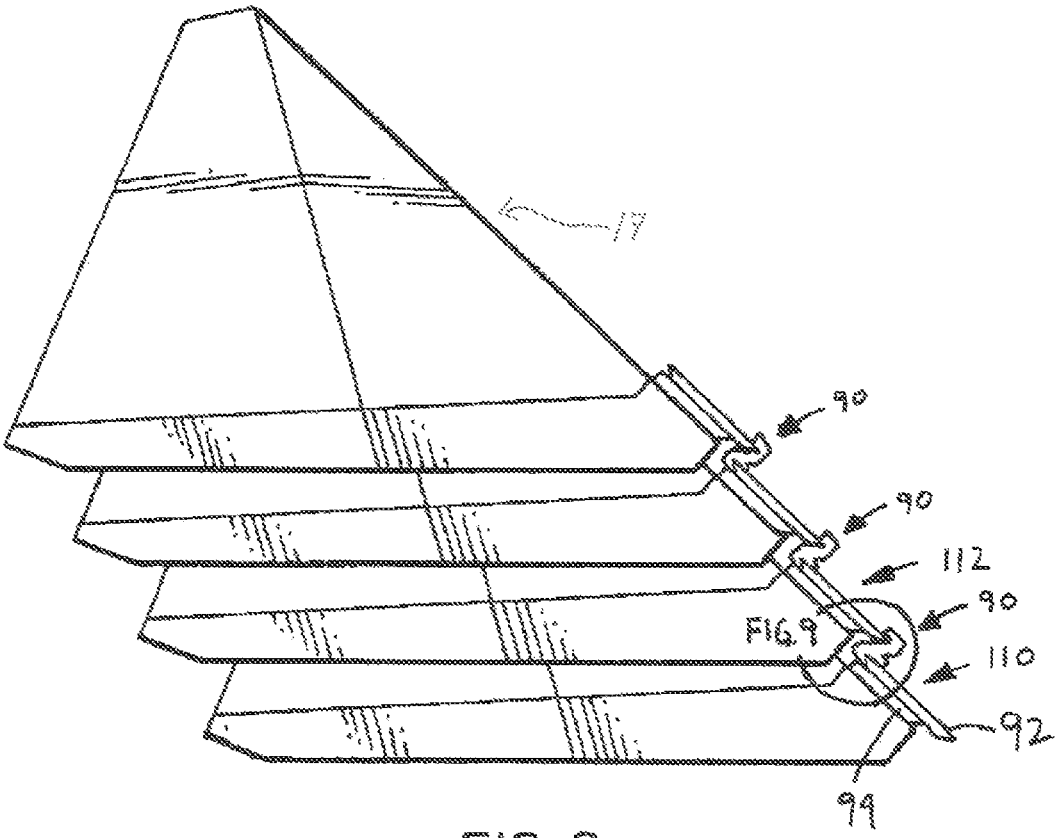
FIG. 8 is a side view of a stack of four buckets according to the invention in which double-ended reverse hooks are used.

FIG. 8 shows a stack of four buckets in which double-ended reverse hooks 90 are placed between successively stacked buckets.

Referring to FIG. 1, the bottom of the bucket is formed by the floor 12 in combination with any structures attached directly or indirectly to the outside face of the floor 12. For example, the bottom of the bucket in FIG. 1 is comprised of the floor 12, the lip plate 21, and the bolt-on edge 19. The inside of the bottom of the bucket is indicated by the numeral 11 in FIG. 1 while the underside or outside of the bottom of the bucket is indicated by the numeral 17 in FIGS. 3 and 8.

Referring now to FIG. 3, the leading edge of the bottom of the bucket in the preferred embodiment is an edge of the bolt-on edge 19. However in an alternate embodiment without a lip plate 21 and bolt-on edge 19, the leading edge of the bottom of the bucket would be the straight floor leading edge 20.

Figure 9:
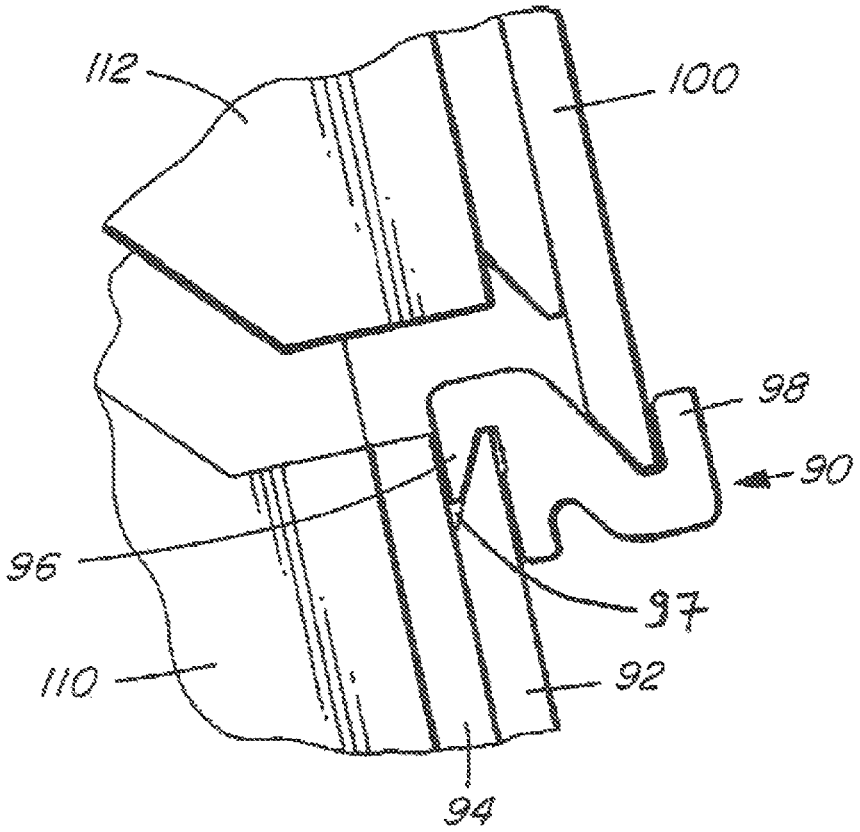
FIG. 9 is an enlarged view of a portion of the stack of four buckets shown in FIG. 8.

Referring now to FIGS. 8 and 9, to stack buckets, a first bucket 110 is placed on a surface such that the opening of the first bucket faces downwards. The downward facing portion 96 of at least one double-ended reverse hook 90 is placed into a gap on the outside of the bottom of the first bucket 110.

Various structures may be provided on the outside of the bottom of the bucket to create a gap to receive the downward facing portion 96 of the hook 90. Such structures may be directly or indirectly attached to the floor of the bucket. For example, there may be a bolt-on edge 92 and lip plate 94 provided outside the bottom of the bucket which then become the leading edge of the bottom of the bucket. The bolt-on edge 92 and the lip plate 94 may be configured to create a gap as at 97 between them to receive the hook 90. In the preferred embodiment, the hook 90 is installed in a gap formed between the bolt-on edge 92 and the lip plate 94, as illustrated in FIG. 9. The hook 90 is installed with the downward facing hook portion 96 into the gap 97 on the lowermost bucket 110. The upward facing portion 98 of the same hook 90 receives the bolt-on edge 100 of the next bucket 112. Two such double-ended reverse hooks are preferred between each pair of successive buckets although more or less hooks may be used.

Once the one or more hooks 90 are in place outside of the bottom of the bucket, the upward facing end(s) of the hook(s) are positioned to receive and support the leading edge of the bottom of the next bucket that is stacked above the underlying bucket. As shown in FIG. 9, the portion of the next bucket 112 that may be supported by the upward facing end 98 of the hook 90 may be the bolt-on edge 100 of the next bucket 112 in the preferred embodiment. In an alternate embodiment, the floor leading edge of the next bucket 112 may be supported by the upward facing end 98 of the hook.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A stackable bucket for heavy equipment comprising a substantially rectangular top wall having parallel side edges, a completely planar floor that tapers from a straight floor leading edge to a floor trailing edge, wherein said top wall and said floor are at an acute angle to each other, and sides that each of the sides includes a bend that divides each of said sides into a bottom side portion and a top side portion wherein said bottom side portion is substantially perpendicular to said completely planar floor and said top side portion is angled inwards in relation to said bottom portion such that each of said sides connects to both the tapering floor and the parallel side edges of the top wall.

2. A stackable bucket for heavy equipment comprising:

a completely planar floor having a straight floor leading edge and first and second floor side edges;

said floor further comprising a floor trailing edge that is shorter in length than the straight floor leading edge;

a top wall having a top wall leading edge, wherein said top wall and said floor are at an acute angle to each other;

said top wall further comprising:

first and second top wall side edges that are parallel to one another;

a top wall trailing edge that is equal in length to said top wall leading edge; and, a first side wall connected to said first floor side edge and said first top wall side edge;

a second side wall connected to said second floor side edge and said second top wall side edge;

wherein said first side wall comprises a first bend that divides said first side wall into a first bottom side portion and a first top side portion wherein said first bottom side portion and the first top side portion are at an angle to each other and said second side wall comprises a second bend that divides said second side wall into a second bottom side portion and a second top side portion wherein said second bottom side portion and the second top side portion are at an angle to each other;

wherein said first bottom side portion and second bottom side portion are substantially perpendicular to said completely planar floor;

wherein said first top side portion is angled inwards in relation to said first bottom side portion and said second top side portion is angled inwards in relation to said second bottom side portion; and wherein said top wall trailing edge is connected to said floor trailing edge.

3. The stackable bucket of claim 2 wherein said first bend is diagonal in relation to said first side wall and wherein said second bend is diagonal in relation to said second side wall.

4. The stackable bucket of claim 2 further comprising a first gusset connected to said top wall and said first side wall and a second gusset connected to said top wall and said second side wall;

wherein said first gusset has a first flat portion and said second gusset has a second flat portion; and wherein when said stackable bucket is stacked on top of a lower bucket of the same configuration, said first flat portion rests on a first side wall of said lower bucket and said second flat portion rests on a second side wall of said lower bucket.

5. An assembly of stackable buckets wherein each of said buckets is a stackable bucket for heavy equipment comprising a substantially rectangular top wall having parallel side edges, a floor that tapers from a floor leading edge to a floor trailing edge, and sides that each of the sides includes a bend such that each of said sides connects to both the tapering floor and the parallel side edges of the top wall, said assembly comprising:

said buckets; and at least one double-ended reverse hook installed on a first of said buckets using a downward facing end of said hook;

wherein an upward facing end of said hook supports a portion of a leading edge of a bottom of another of said buckets;

and wherein successive buckets nest into one another.

6. The assembly of claim 5 wherein said downward facing end of said hook is engaged in a gap provided between a lip plate welded to a floor of said first bucket and a bolt-on edge connected to said lip plate.

7. The assembly of claim 5 wherein said at least one double-ended reverse hook is installed on an outside of a bottom of said first of said buckets.

8. A method of stacking buckets wherein each bucket is a stackable bucket for heavy equipment comprising a substantially rectangular top wall having parallel side edges, a floor that tapers from a floor leading edge to a floor trailing edge, and sides that each of the sides includes a bend such that each of said sides connects to both the tapering floor and the parallel side edges of the top wall, said method comprising:

placing a first bucket on a surface such that an opening of said first bucket faces downward;

providing at least one double-ended reverse hook having a downward facing end and an opposing upward facing end;

placing said at least one double-ended reverse hook on said first bucket;

placing a second bucket over said first bucket such that a leading edge of a bottom of said second bucket is supported by said upward facing end of said at least one hook.

9. The method of claim 8 wherein said leading edge of the bottom of said second bucket comprises a floor leading edge of said second bucket.

10. The method of claim 8 wherein said leading edge of the bottom of said second bucket comprises a bolt-on edge and a lip plate.

11. The method of claim 8 wherein said downward facing end of said at least one double-ended reverse hook is placed in a gap between a lip plate welded to a floor of said first bucket and a bolt-on edge connected to said lip plate.

12. The method of claim 8 wherein said at least one double-ended reverse hook is placed on an outside of a bottom of said first bucket.

* * * * *